United States Patent [19]

Kieswetter

[11] Patent Number: 4,995,576

[45] Date of Patent: Feb. 26, 1991

[54] MOUNTING FOR ROADSIDE MAILBOX

[76] Inventor: Carl A. Kieswetter, R.R. 1, St Agatha, Ontario, Canada, N0B 2L0

[21] Appl. No.: 15,690

[22] Filed: Feb. 17, 1987

[30] Foreign Application Priority Data

Mar. 7, 1986 [CA] Canada ..... 503576

[51] Int. Cl.[5] ..... B65D 91/00

[52] U.S. Cl. ..... 248/145; 403/67; 403/162; 248/417

[58] Field of Search ..... 248/145, 417, 289.3, 248/131, 202.1, 144, 415, 296; 232/39; 403/67, 161, 162, 163, 164

[56] References Cited

U.S. PATENT DOCUMENTS

| | | | |
|---|---|---|---|
| 2,079,510 | 5/1937 | King et al. | 248/289.3 X |
| 2,149,050 | 2/1939 | Hajicek | 248/145 |
| 2,605,073 | 7/1952 | Buck | 248/145 X |
| 3,802,656 | 4/1974 | Virblas | 248/145 |
| 3,881,650 | 5/1975 | Schmidt | 248/145 X |
| 4,113,213 | 9/1978 | Gay et al. | 232/39 X |
| 4,130,239 | 12/1978 | Belsheim | 232/39 |
| 4,187,978 | 2/1980 | Dowker | 232/39 |

*Primary Examiner*—Karen J. Chotkowski

*Attorney, Agent, or Firm*—Anthony Asquith & Co.

[57] ABSTRACT

The mailbox support-mounting disclosed has a pivoting arm. If the mounting receives a blow, e.g. from a snow-plow blade or from a vandal, the arm swings aside. After swinging aside, the arm resets itself to a central equilibrium position. The restoring force to reset the arm is provided by gravity, in that the pivot axis is set at an angle, and slopes forwards towards the road. The pivot bearing is sturdy and well-located, yet the bearing is inexpensive and not prone to seizure.

5 Claims, 2 Drawing Sheets

MOUNTING FOR ROADSIDE MAILBOX

The invention concerns roadside mailboxes.

In rural areas, it is common for mailboxes to be mounted on posts at the roadside. In areas that have snow, it is common for the groundpost to be set some way back from the side of the road, and for the mailbox itself to be set at the end of an arm, the arm being mounted on the groundpost. The arrangement provides a clear space underneath the mailbox, so that a snow-plow blade may pass without hitting the mailbox.

A problem with the common "cantilever-arm" mounting is that the margin is very tight between having the mailbox low enough so that the mailman can reach the box without getting out of the mail delivery vehicle, and yet high enough that the snow-plow blade can pass clearly underneath the mailbox. Mailboxes, as a result, are from time to time struck by snow-plows, and damaged.

Another problem with the cantilever-arm mounting is that the mounting looks fragile, and looks vulnerable to damage. A cantilever-arm mailbox stands as a positive invitation to vandalism: it seems to the vandal, even a vandal with only a passing acquaintance with the rules of levers and mechanics, that he can easily break off the mounting simply by pulling on the mailbox, and of course that is true.

These problems have been recognized in the past and attempts have been made to produce a cantilever-arm mounting which can absorb the occasional blow from a snow-plow blade, and which is difficult for a vandal to damage.

In U.S. Pat. No. 3870262 (11 Mar. 1975, MANNING), the mailbox and the arm are not attached rigidly to the groundpost. When the mailbox receives a blow, the arm detaches itself from the post, and the box and the arm fall to the ground. Such a design of course has the disadvantage that it needs to be reset after receiving a blow. And it has another disadvantage that even a vandal with some conscience will find amusement in the act of knocking a mailbox over, if he knows the box owner will not need to buy and install a new groundpost.

In U.S. Pat. No. 3,881,650 (06 May 1975, SCHMIDT) the arm again is arranged to swing out of the way if the box receives a blow, but in SCHMIDT the arm will automatically swing back to its normal position afterwards. This is because of the return springs, as shown.

Apart from the basic expense of the springs themselves, there are some other problems with the idea of spring-return. First, it is hard to get two springs to be exactly identical; therefore, there will have to be some form of adjustment so that the normal at-rest position of the mailbox does not look crooked with the respect to the road. Secondly in an article that has to stand exposed to the elements for years, exposed moving parts should be kept to an absolute minimum. However, the concept is a good one of a mailbox that swings aside when it receives a blow, and afterwards re-sets itself automatically. The present invention is aimed at providing a mailbox which uses that concept, but which does not have the disadvantages mentioned above.

In the invention, the mailbox is mounted on the end of an arm, and the arm is pivoted to the groundpost, as was the case with SCHMIDT, but the difference is that in the invention the axis of pivoting movement between the arm and the groundpost lies at a substantial angle to the vertical. The force that re-sets the arm after a blow therefore can be—not springs as taught by SCHMIDT—but gravity. Preferably, the groundpost is set so to lean forwards at the said angle to the vertical, in a plane that lies at right angles to the length of the road.

Examples of mailbox mountings which embody the invention are illustrated in the accompanying drawings in which.

Figure 1:
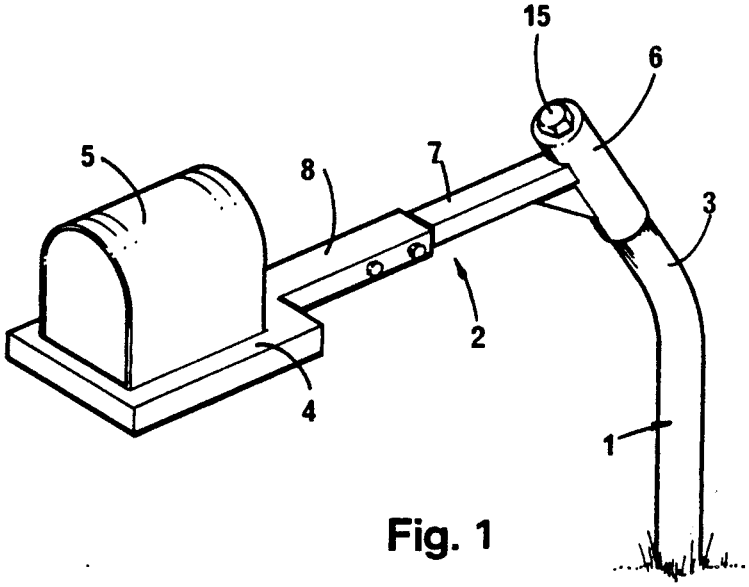
FIG. 1 is a pictorial view of a firest mailbox mounting.

The mailbox mounting or support shown in the drawings comprises basically a groundpost 1 and a mailbox-receiving-arm 2. The groundpost 1 is fixed rigidly in the ground, and the arm 2 is mounted for pivoting with respect to the post 1.

The post 1 is made from a steel pipe, the upper portion 3 of which is bent at a substantial angle to the rest of the post. The post is set in the ground so that the upper-portion 3 slopes forwards towards the roadway, and at right angles to the length of the road.

The mailbox-receiving-arm 2 at one end includes a flat platform 4, onto which the mailbox itself 5 is bolted. The mailbox 5 does not overhang the platform, so a snow-plow will strike the platform 4 rather than the box 5.

The arm 2 has an inner component 7 and an outer component 8, which are arranged to slide with respect to each other, for the purpose of adjusting the length of the arm. The components 7,8 are of non-round configuration, so that the platform 4 is constrained against tipping.

At its other end, the arm 2 is provided with a hollow tube 6. The tube 6, in conjunction with the upper portion 3 of the post 1, comprises a bearing upon which the arm 2 may swing with respect to the post 1. The post 1 is the stator, and the tube 6 is the rotor, of the bearing.

The very end of the post 1 is fitted with a welded-in disc 10, to which is welded a nut 11. The tube 6 has a cap 12. A sleeve 13 fits in a hole 14 in the cap 12, and a bolt 15 holds the assembly together, as shown. The bolt 15 may be of the tamper-proof kind, if that is desired as an added refinement. It may be regarded that the sleeve 13 is a further stator, and the cap 12 is a further rotor, of the said bearing.

The arrangement of the post and arm is such that if the arm receives a blow—as from a snow-plow blade—the arm will swing about the pivot, and not be damaged. Afterwards, the arm will automatically swing back to the central, equilibrium position.

It is recognised in the invention that special attention should be given to the manner of arranging the pivot axis and bearing between the post and the arm. The bearing should constrain the arm against all modes of movement other than the desired pivoting movement. In particular, the bearing should restrain the arm against vertical up/down movement of the mailbox-end of the arm. The bearing should therefore be long, in the direction of the axis of the bearing.

On the other hand, the bearing should be designed so as not to seize up, even though the mailbox and its support are exposed to all weathers, and even though the (steel) surfaces inside the bearing may become rusty.

However, it is recognised that partial seizure of the bearing would be acceptable. If, as a result of partial seizure, the arm became somewhat stiff to turn, and did not swing back quite to the central equilibrium position, the owner, or the mailman, could easilypush the arm the last small distance.

It is recognised in the invention that the required degree of constraint and location for the arm,.together with freedom to swing, can be met by the very inexpensive bearing as shown. There is no need for other anti-friction measures, which would entail the need for seals, lubrication and extra components. Of course, extra anti-friction and anti-seizure measures can be taken if desired: a grease nipple can, for example, be fitted to the tube 6 very inexpensively.

The clearance between the tube 6 and the post 1 should be large enought to resist seizure. A diametral gap of 3 mm is suggested for most environments.

In theory, the question whether any unlubricated bearing is or is not prone to seizure depends on how tightly the rotor and stator fit together, and on the size of the interface area between rotor and stator. On the other hand, the size of the interface area is dictated by the robustness required of the bearing. The tightness of the rotor/stator clearance is dictated by the required fit.

The arrangement of the bearing as illustrated means that the required robustness and the required fit are achieved, yet the bearing at the same time has a marked resistance to seizure. This is because the diametral fit of the sleeve 13 in the hole 14 in the tube cap 12 is tighter (at about 1 mm) than the diametral fit of the tube 6 to the post 1, an arrangement which causes the metal of the tube 6 to be held clear of the metal of the post 1 except at the one spot which is indicated by reference numeral 16 in FIG. 2. The area of the interface between the hole 14 and the sleeve 13 is much smaller than the area of the interface between the tube 6 and the post 1, and therefore is much less prone to seizure, even though the clearance between the hole 14 and the sleeve 13 is tighter.

Figure 2:
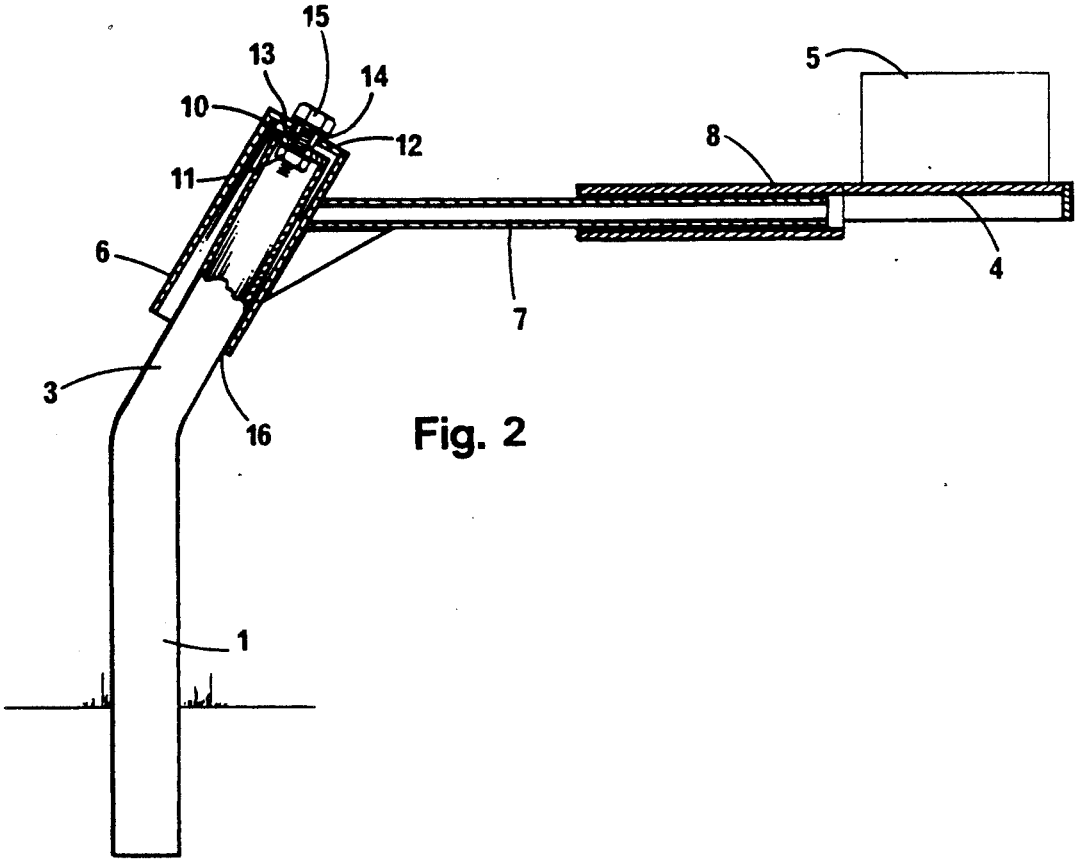
FIG. 2 is a cross-sectional view of the mounting of FIG. 1.

The self re-setting mailbox support of FIGS. 1 and 2 is very sturdy, is not prone to seizure, is not damaged by a blow from a snow-plow, and is resistant to vandalism. In addition to these advantages, the support desribed is pleasing in appearance, having no unsightly springs or other exposed mechanism.

The reason the FIG. 1 mounting is so resistant to damage from vandals is that the arm may be rotated around in a complete circle, without breaking. This may be contrasted with the design shown by SCHMIDT, where the mechanism could be broken simply by pulling far enough on the arm.

Figure 3:
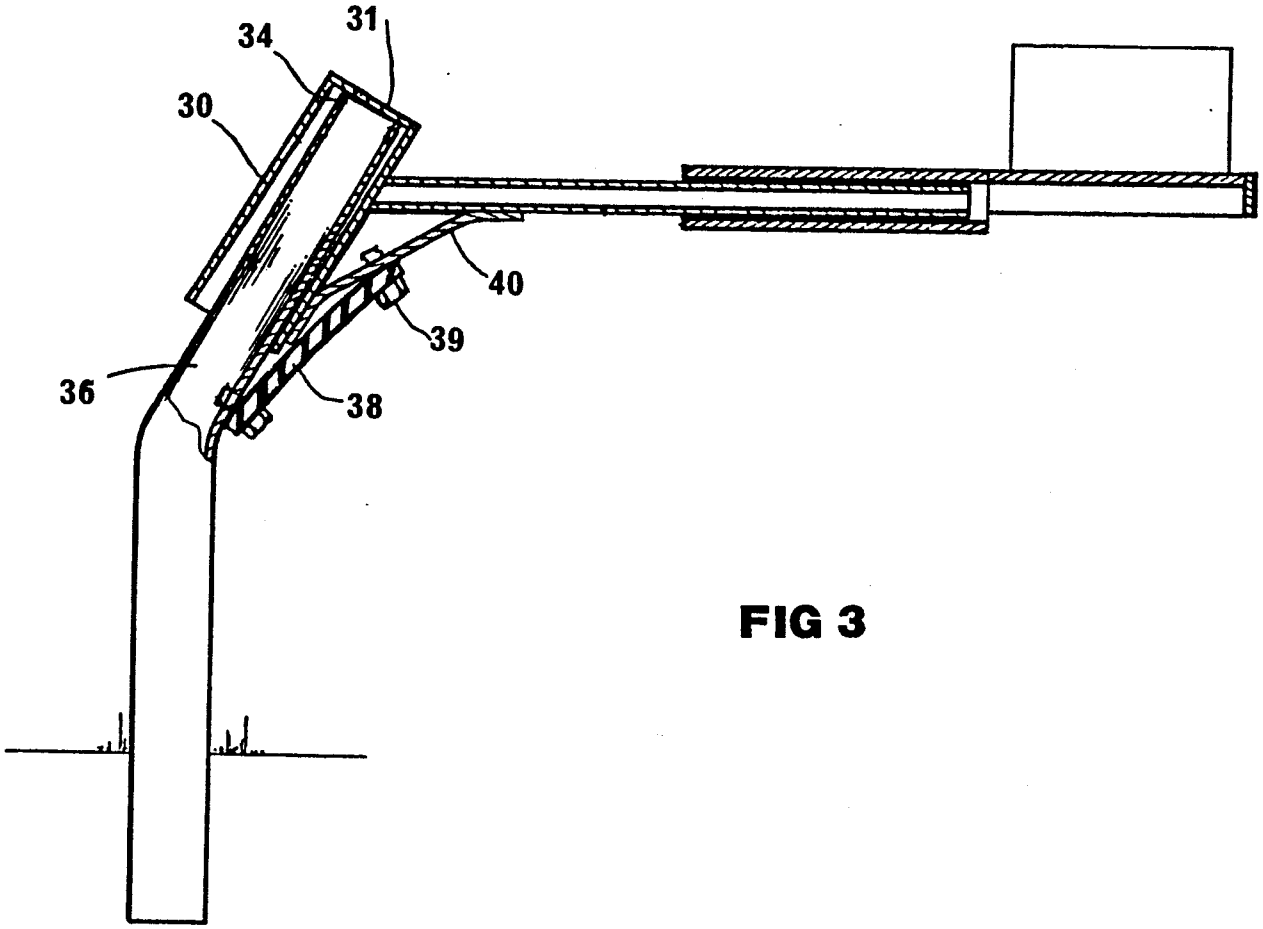
FIG. 3 is a cross-sectional view of an alternative mailbox mounting.

The mailbox mounting shown in FIG. 3 is similar to that shown in FIGS. 1 and 2. In FIG. 3, there is no sleeve 13 or hole 14. The tube 30 has a cap 31, but the cap 31 is plain.

The top end 34 of the post 36 also is plain, and the arrangement is that the tube 30 simply slips over the post 36, until the cap 31 rests on the top end 34.

In the mounting of FIG. 3, to retain the tube 30 on the post 36, a strap 38 is attached between the tube and the post. The strap 38 is made of tough, resilient, plastic material, such as nylon. The gusset 40 and the post 36 are threaded, for the purpose of receiving the strap fixing-bolts 39.

The strap 38 acts not only to retain the tube 30 on the post 36, but acts also as a return spring, to return the arm if the arm should swing aside. The strap 38 can only have a fairly rudimentary return effect, but it is recognised in the invention that even such a rudimentary self-centering effect is useful in bringing the arm back smartly: the main return force of course being gravity.

It will be noted that the strap 38 might be broken if a vandal were to pull the arm round through a complete circle. Also, the strap 38 is exposed to the elements, and the strap detracts slightly from the smooth outline of the rest of the mounting. As compared with the springs of SCHMIDT however, the strap 38 is quite unobtrusive and not prone to deterioration over the years.

The bearing as described may be regarded as a combination of journal bearing and thrust bearing components. The journal bearing (or cylindrical bearing) component is that portion of the structure of the bearing which constrains the tube against all modes of movement other than (a) rotation about the bearing axis and (b) movement along the axis. The thrust bearing (or axial bearing) component is that portion of the structure of the bearing which constrains the tube against movement along the axis.

In FIG. 2, the rotor of the journal bearing is the tube 6 (together with the hole 14) and the stator of the journal bearing is the upper portion 3 of the post (together with the sleeve 13). The stator of the thrust bearing is the top end of the post, at the disc 10, and the rotor of the thrust bearing is the cap 14.

In FIG. 3, the rotor of the journal bearing is the tube 30, and the stator of the journal bearing is the upper portion 36 of the post. The stator of the thrust bearing is the top end 34 of the post, and the rotor of the thrust bearing is the cap 31.

In the invention, there is a large clearance between the rotor and stator of the journal bearing.

The rotor and stator of the thrust bearing remain constantly in contact, in supporting the weight of the arm. In the invention, the thrust bearing is protected from the elements, in that the tube 6;30 extends, skirt-like, well below the thrust bearing

I claim:

1. Mounting for a roadside mailbox, wherein:

the mounting includes a mailbox-receiving arm, and a groundpost;

the mounting includes a journal bearing means and a thrust bearing means, for pivoting the arm about a pivot axis relative to the groundpost;

the bearing means are so arranged that the said pivot axis between the arm and the ground post is inclined at a substantial angle to the vertical;

the journal bearing means includes a journal bearing rotor and a journal bearing stator;

the journal bearing stator comprises an upper portion of the said groundpost;

the journal bearing rotor comprises a tube, the tube being unitary with the arm;

the tube has an upper end and a lower end, and includes a cap, which closes off the said upper end of the tube;

the arrangement of the mounting is such that the cap of the tube lies in operative engagement against the top of the groundpost;

the thrust bearing means includes a thrust bearing rotor and a thrust bearing stator;

the thrust bearing means is so disposed and arranged that the weight of the arm is transmitted to the groundpost by direct rubbing contact between the thrust bearing rotor and the thrust bearing stato during pivoting of the arm;

the thrust bearing stator comprises the top of the groundpost;

the thrust bearing rotor comprises the cap;

the lower end of the tube extends a substantial distance down the groundpost from the said thrust bearing means;

the lower end of the tube is in direct rubbing engagement with the groundpost during pivoting of the arm;

and the diameter of the tube is so dimensioned, in relation to the diameter of the post, as to provide a substantial diametral clearance between the lower end of the tube and the post.

2. Mounting of claim 1, wherein:

the journal bearing means includes an upper journal bearing engagement and a lower journal bearing engagement;

the lower journal bearing engagement comprises the said engagement between the lower end of the tube and the groundpost;

the top of the groundpost includes a spigot of substantially smaller diameter than the general diameter of the groundpost;

the cap includes a hole, which is dimensioned to be a guiding fit over the said spigot;

and the upper journal bearing engagement comprises the engagement of the spigot to the said hole.

3. Mounting of claim 2, wherein:

the mounting includes a retention means for detachably securing the arm against removal upwards from the groundpost;

and the said retaining means comprises a threaded fastener, which extends through the said upper bearing engagement.

4. Mounting of claim 1, wherein:

the tube and cap comprise a cover means, the cover means being weatherproof with respect to the top of the groundpost.

5. Mounting of claim 4, wherein:

the mounting includes a retention means for detachably securing the arm against removal upwards from the groundpost;

the retention means comprises a strap of tough resilient plastic material, which is secured between the groundpost and the arm;

and the said strap is so disposed and arranged as to act to urge the arm to a central equilibrium position upon the arm being deflected away from the said position.

* * * * *